US008401215B2

(12) United States Patent
Warren et al.

(10) Patent No.: US 8,401,215 B2
(45) Date of Patent: Mar. 19, 2013

(54) RECEIVER ASSEMBLIES

(75) Inventors: Daniel Max Warren, Geneva, IL (US); Thomas J. Jalava, Homer Glen, IL (US); Brad Olson, Park Ridge, IL (US); Michael J. Abry, Kildeer, IL (US); Earl E. Houcek, Carol Stream, IL (US); Mark F. Halla, Glen Ellyn, IL (US); Charles B. King, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 252 days.

(21) Appl. No.: 12/752,262

(22) Filed: Apr. 1, 2010

(65) Prior Publication Data

US 2010/0254556 A1 Oct. 7, 2010

Related U.S. Application Data

(60) Provisional application No. 61/165,816, filed on Apr. 1, 2009.

(51) Int. Cl.
*H04R 25/00* (2006.01)

(52) U.S. Cl. ..... 381/328; 181/129; 181/130; 181/135; 181/137

(58) Field of Classification Search ..... 381/328; 181/129, 130, 135, 137
See application file for complete search history.

(56) References Cited

U.S. PATENT DOCUMENTS

| | | | | | |
|---|---|---|---|---|---|
| 3,848,090 | A * | 11/1974 | Walker | 381/152 |
| 4,418,787 | A * | 12/1983 | Eggert et al. | 181/130 |
| 5,113,967 | A * | 5/1992 | Killion et al. | 181/132 |
| 5,359,157 | A * | 10/1994 | Liu | 181/129 |
| 5,654,530 | A | 8/1997 | Sauer et al. | |
| 6,671,381 | B1 | 12/2003 | Lux-Wellenhof | |
| 6,704,429 | B2 * | 3/2004 | Lin | 381/380 |
| 6,931,142 | B2 * | 8/2005 | Fushimi | 381/325 |
| 7,882,928 | B2 * | 2/2011 | McMahon et al. | 181/135 |
| 8,031,900 | B2 * | 10/2011 | Dyer et al. | 381/380 |
| 8,170,244 | B2 * | 5/2012 | Ryan et al. | 381/174 |
| 2007/0121983 | A1 | 5/2007 | Jayanth et al. | |
| 2009/0180653 | A1 * | 7/2009 | Sjursen et al. | 381/322 |

FOREIGN PATENT DOCUMENTS

| | | | |
|---|---|---|---|
| JP | 2003-143684 | A | 5/2003 |
| KR | 10-2004-0034762 | A | 4/2004 |

OTHER PUBLICATIONS

International Search Report and Written Opinion for PCT/US2010/029596, dated Oct. 27, 2010.

* cited by examiner

*Primary Examiner* — Forrest M Phillips
(74) *Attorney, Agent, or Firm* — Fitch, Even, Tabin & Flannery, LLP

(57) ABSTRACT

A receiver is provided having a balanced armature motor mechanically interconnected to a displaceable diaphragm component. A front volume changes as the displaceable diaphragm component moves. The front volume is connected to a port. A rear volume changes oppositely to the front volume as the displaceable diaphragm moves. An acoustic channel connects to the port and is also connected to a sound outlet. The sound outlet allows acoustic energy to exit from the acoustic channel. A first acoustic pressure is generated in the front volume as the balanced armature motor moves the diaphragm. The acoustic channel and the internal volume are divided by a common wall section, wherein the common wall section is defined by at least one of the walls of the housing which also provides a portion of at least one wall for the acoustic channel.

18 Claims, 4 Drawing Sheets

FIGURE 10
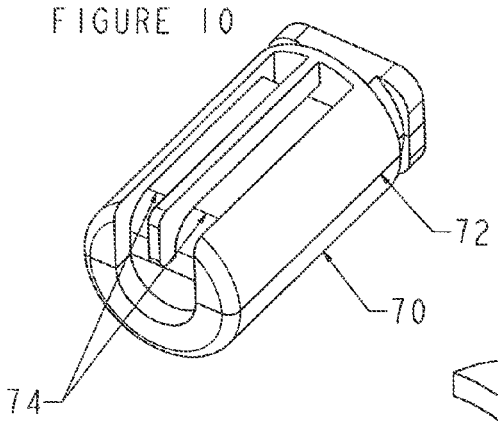
FIGURE 11
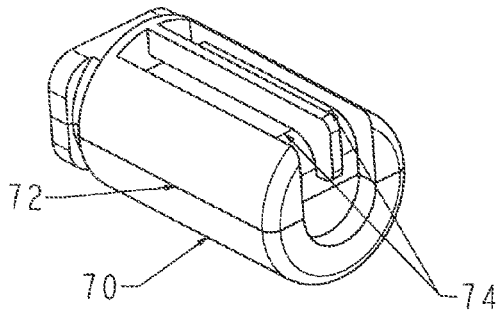
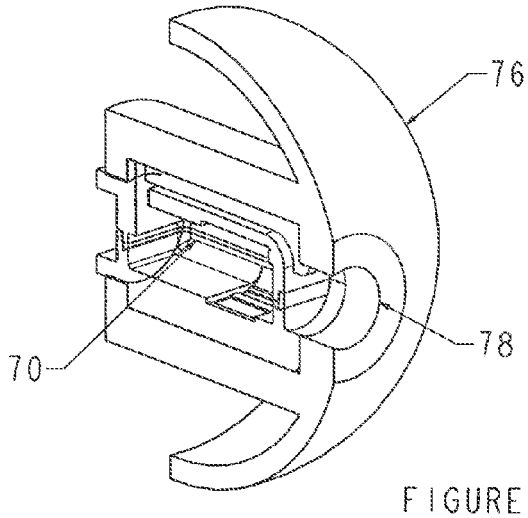
FIGURE 12
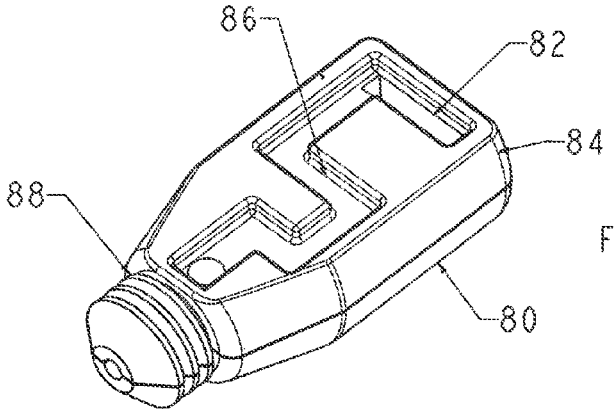
FIGURE 13

RECEIVER ASSEMBLIES

CROSS REFERENCE TO RELATED APPLICATION

This application claims benefit under 35 U.S.C. §119 (e) to U.S. Provisional application No. 61/165,816, filed Apr. 1, 2009 and entitled "Receiver Assemblies," and having Daniel Warren as the first named inventor, the contents of which are incorporated herein by reference in their entirety.

TECHNICAL FIELD

The present disclosure relates to receiver assemblies and methods for modifying the frequency response of an in-ear device with a minimal increase in in-ear device length.

BACKGROUND

As seen in the industry, hearing aids are being designed according to smaller dimensions. These hearing aids include Behind-The-Ear (BTE), In-The-Ear (ITE), and Receiver-In-Canal (RIC). Newer types of hearing aids (RIC's) place the receiver in the ear canal. In general, an in-ear device, such as those mentioned above, is limited by certain constraints, such as, for example, comfort. Comfort may be achieved in two ways. In a first method, a shell may be custom molded to the contours of the individual ear canal. This shell houses the in-ear acoustic device. In this case, space available for the in-ear device is constrained by the requirement that the device must not protrude from the shell on any of the surfaces that are contoured to match the canal shape.

In a second method, the in-ear device may be partially encompassed by a compliant material called an ear-dome or tulip. The ear dome prevents the hard material of the in-ear device from contacting the canal walls and serves to align the in-ear device along the axis of the ear canal. The ear dome may have features to allow air to communicate between the tympanic membrane (TM) and environment around the user's head for a vented or open-ear response, or may provide an effective seal to air flow. In the sealed configuration, the acoustic outlet must be on the TM side of the seal.

The ear canal is typically not a straight conduit; it may have bends in it. In addition, the cross sectional shape and area vary with distance toward the TM. These features are unique to each individual and ear. It is a challenge to comfortably fit a hard object of some nominal length and effective diameter into individual ear canals. Moreover, it is desirable from a manufacturing and distribution standpoint to have an in-ear device design fit comfortably into the largest percentage of potential wearers as possible (referred to as the "fit rate"). In general, the fit rate of an in-ear device decreases with increasing device length.

The sound pressure generated by a receiver operating directly into the ear canal (that is, where the acoustic channel is nonexistent or provided only by the formed metal tube typically attached to the port of receivers) has at least one peak at the mechanical resonance frequency of the receiver, generally around 3 kHz. A second resonance may occur at or above 10 kHz caused by the effective inertance of the air in the port (and residual acoustic channel of the metal tube, if present) resonating with the effective compliance of the front volume. A deep valley exists between the two response peaks exhibited by these resonances. It is often desirable to have a lower peak-to-valley ratio. The peak-to-valley ratio can be reduced by introducing an acoustic channel between the port and acoustic outlet. The acoustic channel is an acoustic transmission line between the port and acoustic outlet. In a simple analysis, this acoustic transmission line can be represented by a simple inertance (mass), which allows for shifting the frequency of the acoustic resonance by adding inertance to the system, by means of an acoustic channel The acoustic channel creates an additional acoustic load upon the receiver, thereby modifying its output. These two points of view (channel modifies receiver through loading, or channel modifies acoustic output through the transmission line) are consistent with and mathematically equivalent to each other.

The acoustic channel (viewed as a transmission line) will introduce a time delay between the acoustic outlet and the port, equal to the effective length of the acoustic channel divided by the speed of sound. This provides a definition of the effective length of the acoustic channel. An acoustic channel with a relatively small cross-sectional dimension that is much larger than a wavelength can be considered lossless, meaning that the sound will not attenuate as the wave propagates down its length. However, at smaller dimensions, the acoustic wave begins to exchange heat with the walls of the acoustic channel, thereby attenuating the wave. This is exhibited in the frequency response as reduced amplitude of the acoustic peaks and is identified as damping.

To a reasonable degree of accuracy, the behavior of the acoustic channel can be represented by a lossy transmission line parameterized by its cross-sectional area and length. Thus, area and length of the channel are independently important in the design of the acoustic channel. An acoustic channel with area that varies with length can be segmented and represented by a series of transmission lines; other analysis methods also exist. By varying the area along the length of the channel, the acoustic channel may also be designed to act at least partially as an acoustic impedance matching element between the port and the acoustic impedance presented at the outlet.

In the current state of the art, an acoustic channel is provided by attaching a length of tubing to the port of a receiver. The other end of the tubing functions as, and is referred to, as the acoustic outlet. In a Behind The Ear device (BTE), the receiver is attached to a tube (typically flexible for feedback control reasons), which is attached to an earhook assembly, and having a channel formed in its interior. The earhook assembly then is attached to a clear, flexible tube through a custom-molded earmold. This provides a relatively long acoustic channel, causing many acoustic resonances. Tube segment areas and lengths can be chosen to provide a wide bandwidth response and peak-to-valley ratios well within the range of acceptability.

In an ITE device, a short, flexible tube is attached to the port of the receiver and to a canal end of the ITE. This tube is approximately 1 mm to 2 mm in diameter and somewhere between 3 mm and 10 mm in length. The actual length is usually chosen during an assembly phase of the hearing aid to place the receiver within the shell in such a way that the receiver case does not contact the shell.

In a RIC device, a secondary body of the hearing instrument separate from the main body houses the receiver or receiver motor. A short, cylindrical length of the housing is allowed to protrude in front of the receiver to act as a channel. Typically, this is between 1 mm and 3 mm in diameter and about 2 to 3 mm in length. This protrusion is also the feature over which the ear dome section of the hearing instrument fits, and may have ridged features to help prevent the ear dome from accidently slipping away. In particular, this style of acoustic channel is ineffective at modifying acoustic resonances. The channel is too short to have any useful effect, and increasing its length is quite difficult due to fit rate considerations. In all cases, wax protection devices or acoustic dampers may be added at the acoustic outlet or along the length of the channel.

A need, therefore, exists for modifying the frequency response of an in-ear device with a minimal increase in in-ear device length, thereby maintaining an acceptable fit rate.

BRIEF DESCRIPTION OF THE DRAWINGS

For a more complete understanding of the disclosure, reference should be made to the following detailed description and accompanying drawings wherein:

FIG. 10 is a perspective view of a receiver assembly in an embodiment of the present invention;

FIG. 11 is another perspective view of the receiver assembly of FIG. 10;

FIG. 12 is a cutaway view of the receiver of FIG. 10 housed within an ear dome, in an embodiment of the present invention; and FIG. 13 is a cutaway view of a receiver assembly having a non-linear acoustic channel in an embodiment of the present invention.

Figure 1:
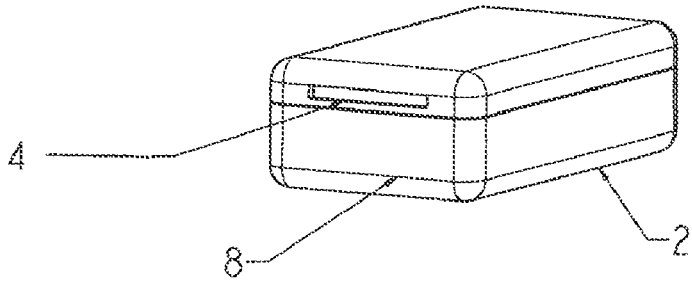
FIGURE 1 (PRIOR ART)
FIG. 1 is a perspective view of a prior art receiver.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

The dimensional length of the system which is comprised of the receiver and acoustic channel is the sum of the dimensional length of the receiver plus the dimensional length of the acoustic channel. In the present invention, one or more surfaces of the acoustic channel are comprised of one or more surfaces of the receiver. By these means, the dimensional length of the receiver and channel system can be reduced by the length that the receiver and acoustic channel have in common. Thus, the present invention improves the fit rate of in-ear devices.

In an embodiment, a receiver is provided, having a balanced armature motor which is mechanically interconnected to a displaceable diaphragm component. The receiver has a front volume, wherein the front volume changes as the displaceable diaphragm component moves and wherein the front volume is connected to a port. The receiver also has a rear volume, wherein the rear volume changes oppositely to the front volume as the displaceable diaphragm moves. The receiver also has an internal volume, which is a combination of the front volume and the rear volume and wherein the internal volume is bounded by a housing having at least one wall. Further, an acoustic channel is provided which connects to the port and is also connected to a sound outlet and wherein the acoustic channel is not part of the internal volume. The sound outlet allows acoustic energy to exit from the acoustic channel. A first acoustic pressure is generated in the front volume as the balanced armature motor moves the diaphragm. The acoustic channel and the internal volume are divided by a common wall section, wherein the common wall section is defined by at least one of the walls of the housing which also provides a portion of at least one wall for the acoustic channel. A portion of the acoustic channel along the common wall section has an acoustic mass greater than 4000 kg/m^4.

In an embodiment, the acoustic mass changes a resonance of the receiver in an amount greater than approximately 100 Hz.

In an embodiment, a portion of the acoustic channel that includes the common wall section bends at an angle greater than approximately 45 degrees.

In an embodiment, the common wall section is substantially parallel to the displaceable diaphragm component.

In another embodiment, a receiver is provided, having a balanced armature motor which is mechanically interconnected to a displaceable diaphragm component. The receiver also has a front volume, wherein the front volume changes as the displaceable diaphragm component moves and wherein the front volume is connected to a port. The receiver also has a rear volume, wherein the rear volume changes oppositely to the front volume as the displaceable diaphragm moves. The receiver also has an internal volume, which is a combination of the front volume and the rear volume and wherein the internal volume is bounded by a housing having at least one wall. The receiver further has an acoustic channel which connects to the port and is also connected to a sound outlet and wherein the acoustic channel is not part of the internal volume. The sound outlet allows acoustic energy to exit from the acoustic channel. A first acoustic pressure is generated in the front volume as the balanced armature motor moves the diaphragm. The acoustic channel and the internal volume are divided by a common wall section, wherein the common wall section is defined by at least one of the walls of the housing which also provides a portion of at least one wall for the acoustic channel. A first length is defined by a length of an acoustic path within the acoustic channel along the common wall section. The diaphragm has a longitudinal axis having a second length. The receiver has a longitudinal axis having a third length. A sum of the first length and the second length is greater than the third length.

In an embodiment, a portion of the acoustic channel that includes the common wall section bends at an angle greater than approximately 45 degrees.

In an embodiment, the common wall section is substantially parallel to the displaceable diaphragm component.

In an embodiment, a receiver is provided. The receiver has a balanced armature motor which is mechanically interconnected to a displaceable diaphragm component. The receiver also has a front volume, wherein the front volume changes as the displaceable diaphragm component moves and wherein the front volume is connected to a port. The receiver also has a rear volume, wherein the rear volume changes oppositely to the front volume as the displaceable diaphragm moves. The receiver has an internal volume, which is a combination of the front volume and the rear volume and wherein the internal volume is bounded by a housing having at least one wall. An acoustic channel is provided which connects to the port and is also connected to a sound outlet and wherein the acoustic channel is not part of the internal volume. The sound outlet allows acoustic energy to exit from the acoustic channel. A first acoustic pressure is generated in the front volume as the balanced armature motor moves the diaphragm. The acoustic channel and the internal volume are divided by a common wall section, wherein the common wall section is defined by at least one of the walls of the housing which also provides a portion of at least one wall for the acoustic channel. A portion of the acoustic channel is bounded by the common wall section and by a second wall section opposite the common wall section. The common wall section is constructed from a first material. The second wall section is constructed from a second material. One or more of the first material and the second material are non-metallic.

In an embodiment, a portion of the acoustic channel that includes the common wall section bends at an angle greater than approximately 45 degrees.

In an embodiment, the common wall section is substantially parallel to the displaceable diaphragm component.

In an embodiment, the first material is more rigid than the second material.

In an embodiment, the acoustic channel surrounds an acoustic path, and the acoustic path is filled or partially filled with partially or fully reticulated rigid foam.

In an embodiment, the first material and the second material are both non-metallic.

In an embodiment, the common wall section is acoustically sealed by at least one of frictional and elastomeric forces.

In an embodiment, a receiver is provided having a balanced armature motor which is mechanically interconnected to a displaceable diaphragm component. A front volume is provided, wherein the front volume changes as the displaceable diaphragm component moves and wherein the front volume is connected to a port. A rear volume is provided, wherein the rear volume changes oppositely to the front volume as the displaceable diaphragm moves. An internal volume is provided, which is a combination of the front volume and the rear volume and wherein the internal volume is bounded by a housing having at least one wall. An acoustic channel is provided which connects to the port and is also connected to a sound outlet and wherein the acoustic channel is not part of the internal volume. The sound outlet allows acoustic energy to exit from the acoustic channel. A first acoustic pressure is generated in the front volume as the balanced armature motor moves the diaphragm. The acoustic channel and the internal volume are divided by a common wall section, wherein the common wall section is defined by at least one of the walls of the housing which also provides a portion of at least one wall for the acoustic channel. A portion of the acoustic channel is bounded by the common wall section and by a second wall section opposite the common wall section. The second wall section is smaller than the common wall section.

In an embodiment, a portion of the acoustic channel that includes the common wall section bends at an angle greater than approximately 45 degrees.

In an embodiment, the common wall section is substantially parallel to the displaceable diaphragm component.

In an embodiment, the acoustic channel surrounds an acoustic path, and wherein the acoustic path is filled or partially filled with partially or fully reticulated rigid foam.

A receiver is comprised of an essentially rigid housing which encloses a volume. The volume is divided by a diaphragm into a rear volume and front volume. A diaphragm is mounted compliantly such that it can be displaced by a balanced-armature motor. Displacement of the diaphragm increases the front volume at the expense of rear volume or vice-versa, depending on the direction of diaphragm displacement. A thru hole, called a port, is provided in one of the rigid walls of the front volume. The volume changes of the front volume due to diaphragm motion generate acoustic pressure changes at the port of the receiver.

A receiver functions most effectively as a pressure transducer, rather than as an acoustic radiator such as a cone loudspeaker. In a radiating type of speaker, motion of a cone creates pressure wavefronts which radiate away from the cone, spreading out through space. Some part of the radiated acoustic wave will be received at the place where the sound is to be utilized, such as a listener's ear. The rest of the acoustic power, which is not received at the listener's ear, is essentially wasted.

Receivers are generally smaller and generate less acoustic power than most loudspeakers, so the sound must be channeled from the place of generation (the port) to the place of utility (the outlet) so as to minimize acoustic power lost to radiation into large spaces. In the current state of the art, the acoustic channel is typically a narrow-diameter piece of flexible tubing which connects to the port of the receiver at one end and terminates in the ear canal.

On some receivers, a short length of metal tubing with an outer diameter intended to allow an interference fit to the inner diameter of the flexible tubing is provided to aid in the mounting and acoustical sealing of the acoustic channel to the port. The metal tube also has a flanged end for reliable welding to the receiver housing. For reasons of mechanical fit of the receiver in a hearing aid, the flange may be designed such that there is an offset between the port and the opening of the metal. The flange may allow sound to travel along the ported face of the receiver a short distance approximately equal to the offset between the centers of the port and the metal tube. The residual acoustic mass of this short segment of acoustic path, as calculated from $\rho l/A$ where $\rho$ is the ambient density of air, l is the length of the segment of acoustic path along the receiver wall within the flange, and A is the cross-sectional area of the same acoustic path segment, is less than 4000 kg/m^4, which is negligible compared to the acoustic mass of the rest of the acoustical system.

It is understood that a better estimation of acoustic mass may be derived by other means.

Figure 2:
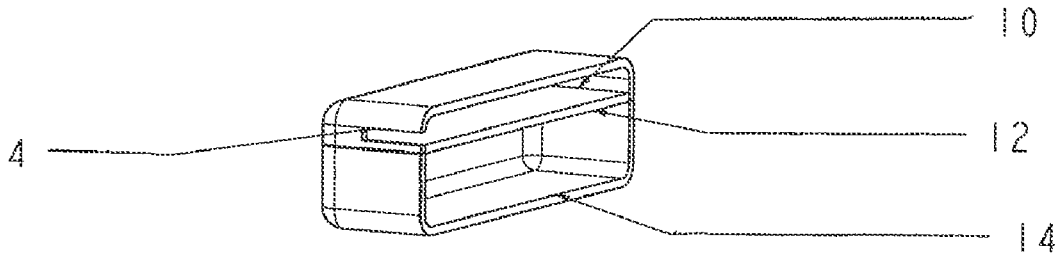
FIGURE 2 (PRIOR ART)
FIG. 2 is a cutaway view of the receiver of FIG. 1.
Figure 3:
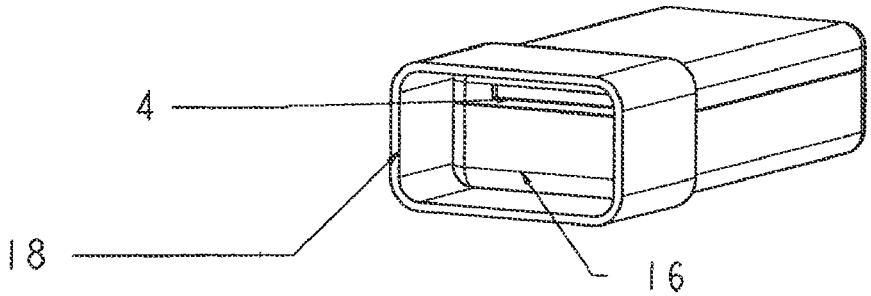
FIGURE 3 (PRIOR ART)
FIG. 3 is a perspective view of a prior art receiver having an acoustic channel added to it.

Referring now to the drawings, where like numerals refer to like parts, FIG. 1 illustrates a prior art receiver 2 having a substantially rectangular shape. The receiver 2 has a port 4 at an end 6. For purposes of this application, the term "port" is used to refer to an opening in a wall 8 of a front volume 10 for communicating an acoustic wave to an acoustic channel. FIG. 2 provides a cutaway view of the receiver 2 of FIG. 1. A diaphragm 12 separates the front volume 10 from a back volume 14. Typically, the diaphragm 12 comprises at least one wall of the front volume 10. A receiver motor (not shown) is typically housed in the back volume 14. FIG. 3 illustrates the receiver 2 having an acoustic channel 16 provided adjacent to the port 4. In essence, the acoustic channel 16 provides an acoustic transmission line communicating an acoustic wave from the port 4 to an acoustic outlet 18.

Figure 4:
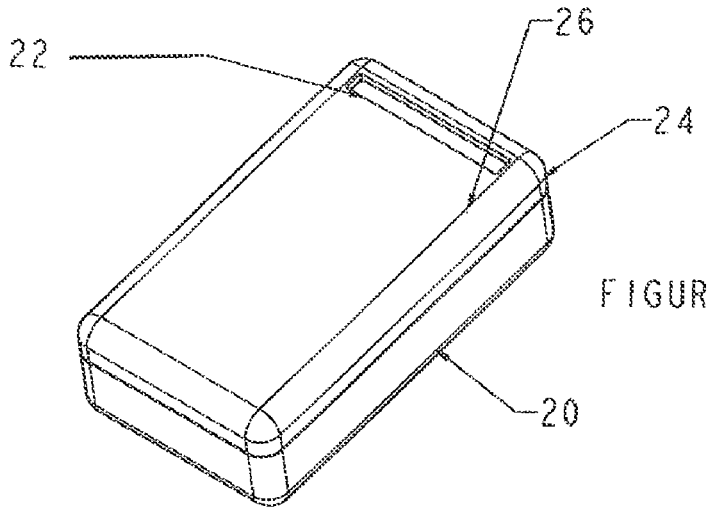
FIG. 4 is a perspective view of a receiver in an embodiment of the present invention.

FIG. 4 illustrates a receiver 20 of the present invention. The receiver 20 may have a port 22 located at an end 24 in a top surface 26. The port 22 may have an area in a range from 0.005 cm^2 to 0.030 cm^2. The preceding example should not be construed as limiting the dimensions of the port 22 with respect to the present invention, as dimensions for any port may be application-specific. Other dimensions, as would be contemplated by those of skill in the art, are within the scope of the present invention.

Figure 5:
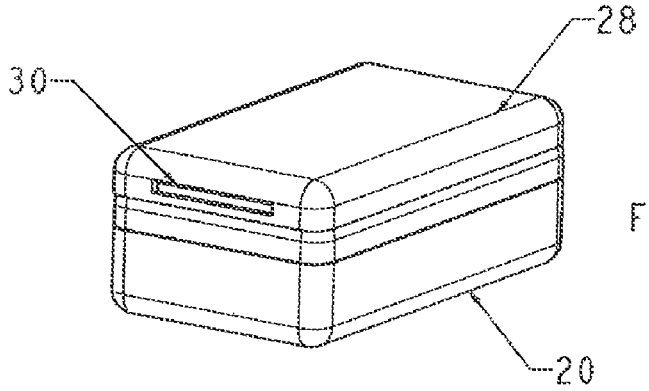
FIG. 5 is a perspective view of the receiver of FIG. 4 having a cover, which acts as an acoustic channel, fitted over it.
Figure 6:
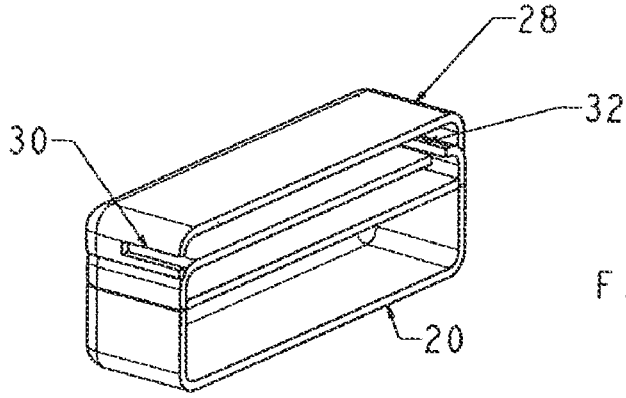
FIG. 6 is a cutaway view of the receiver and cover of FIG. 5.

Acoustic waves generated within the receiver 20 exit from the port 22. FIG. 5 illustrates the receiver 20 with a cover 28 placed over the top surface 26. Acoustic waves which exit from the port 22 travel along a length of the receiver 20 and exit from an acoustic outlet 30 within the cover 28, as illustrated in the cutaway view in FIG. 6 by arrow 32.

Figure 7:
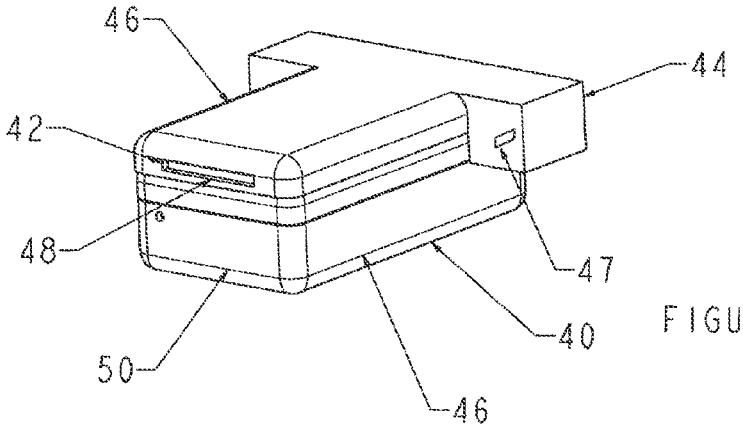
FIG. 7 is a perspective view of a receiver having multiple ports in an embodiment of the present invention.

FIG. 7 illustrates a receiver 40 having a cover 42 placed over a top portion of the receiver. Multiple ports (not shown) are located underneath the cover 42 and may be positioned, for example, at an end 44 of the receiver 40, and/or on sides 46 of the receiver 40. The cover 42 may be shaped to extend over sides 46 of the receiver 40 to cover, for example, a port 47 (shown in dotted line in FIG. 7) which may be formed in a side 46 of the receiver 40, in the front volume of the receiver 40. Acoustic waves exiting these ports travel along the length of the receiver 40 and exit from an acoustic outlet 48 located at an end 50 of the cover.

Figure 8:
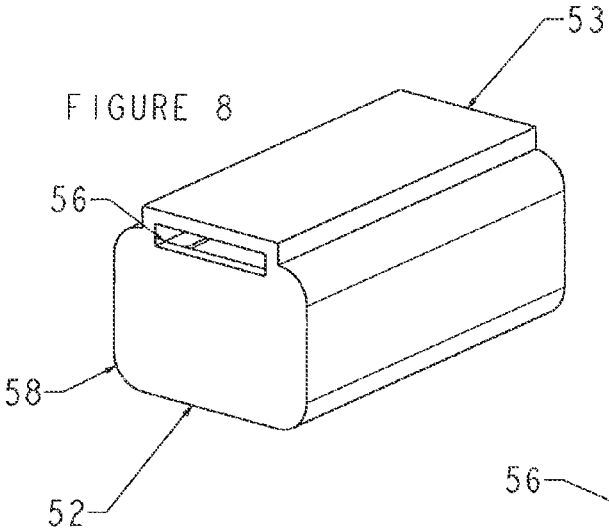
FIG. 8 is a perspective view of a cover for a receiver in an embodiment of the present invention.
Figure 9:
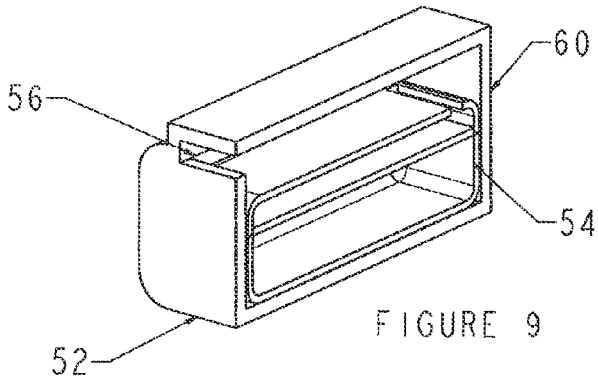
FIG. 9 is a cutaway view of a receiver housed in the cover of FIG. 8 in an embodiment of the present invention.

FIG. 8 illustrates a cover or housing 52 for containing a receiver 54. The housing 52 may be constructed via a molding process and may be constructed from, for example, plastic or the like. The housing 52 may have a flat top surface 53 which may be slightly raised from a body of the housing 52. An acoustic outlet 56 may be formed at an end 58 of the housing 52. FIG. 9 shows the receiver 54 positioned within the housing 52. Acoustic waves exiting from a port in the receiver 54 near an end 60 travel along a length of the housing 52 and exit from the acoustic outlet 56.

FIGS. 10 and 11 provide perspective views of a receiver assembly 70 having a housing 72. The wall of the housing 72 is shaped to define grooves 74. The grooves or sound channels 74 provide a pathway for travel of acoustic waves generated by the receiver assembly 70. FIG. 12 shows the receiver assembly 70 positioned within an ear dome 76 or "tulip" as may be understood in the industry. The ear dome 76 is made of an elastomeric material which fits snuggly around the receiver housing 72. The grooves 74 mostly define a segment of acoustic channel, which is incomplete until assembled to the ear dome 76. The combination of the grooves 74 and the elastomeric material of the ear dome 76 creates a segment acoustic channel or waveguide. Acoustic waves may exit from an opening 78 in the ear dome 76 and toward the ear of the listener. In essence, the ear dome 76 functions similarly to the covers described above. FIG. 13 illustrates a receiver assembly 80 in cutaway view. The receiver assembly 80 may have a port 82 located in a top portion near an end 84. Acoustic waves exiting from the port 82 may travel along a nonlinear pathway or acoustic channel 86 toward an end 88.

In general, the embodiments described above may be utilized for receiver constructed from metal, plastic or the like. Moreover, the receivers described above can be utilized for embodiments involving RIC, CIC, ITE or BTE designs. The present invention modifies known receivers in various ways. For example, the present invention does not utilize a tube, port and terminals on a same face. In an embodiment, a plastic housing may be cup shaped, with electrical connections at a closed end. A cup wall may be contoured such that once the receiver is installed, an acoustic channel is formed between the receiver case and the housing. In an embodiment, the receiver is soldered to the wires and permanently fixed to the cup. In another embodiment, the receiver is removable. Wires may be attached to, for example, spring connectors at the closed end. Ledges located on an open end of the cup are flexible so that the receiver can be inserted and secured after insertion.

In the above embodiments, the port is located such that the distance to the acoustic outlet is an appropriate length to give a target frequency response. The acoustic channel may be molded and formed in its entirety with an opening that aligns with the receiver port and another opening for the acoustic outlet. The channel may be molded or formed with one wall missing so it nestles on top of the cover that forms the front volume. The cover serves as one wall of the channel.

In an embodiment in which a port is on side or rear of the receiver, the channel component may be shaped to reach around an edge to seal to receiver and route acoustic wave. In an embodiment, the channel is constructed whereby one of the walls or faces is provided by the flexible material of the ear dome. In another embodiment, the channel is created out of reticulated open cell foam which gives structure. Walls which should be sealed to restrict the path of the acoustic wave to a path from the port to the outlet can be covered by a very thin film.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A receiver comprising;

a balanced armature motor which is mechanically interconnected to a displaceable diaphragm component;

a front volume, wherein the front volume changes as the displaceable diaphragm component moves and wherein the front volume is connected to a port;

a rear volume, wherein the rear volume changes oppositely to the front volume as the displaceable diaphragm moves;

an internal volume, which is a combination of the front volume and the rear volume and wherein the internal volume is bounded by a housing having at least one wall;

an acoustic channel which connects to the port and is also connected to a sound outlet and wherein the acoustic channel is not part of the internal volume;

wherein the sound outlet allows acoustic energy to exit from the acoustic channel;

a first acoustic pressure being generated in the front volume as the balanced armature motor moves the diaphragm;

wherein the acoustic channel and the internal volume are divided by a common wall section, wherein the common wall section is defined by at least one of the walls of the housing which also provides a portion of at least one wall for the acoustic channel;

wherein a portion of the acoustic channel along the common wall section has an acoustic mass greater than 4000 kg/m^4.

2. The receiver of claim 1, wherein the acoustic mass changes a resonance of the receiver in an amount greater than approximately 100 Hz.

3. The receiver of claim 1, wherein a portion of the acoustic channel that includes the common wall section bends at an angle greater than approximately 45 degrees.

4. The receiver of claim 1, wherein the common wall section is substantially parallel to the displaceable diaphragm component.

5. A receiver comprising;

a balanced armature motor which is mechanically interconnected to a displaceable diaphragm component;

a front volume, wherein the front volume changes as the displaceable diaphragm component moves and wherein the front volume is connected to a port;

a rear volume, wherein the rear volume changes oppositely to the front volume as the displaceable diaphragm moves;

an internal volume, which is a combination of the front volume and the rear volume and wherein the internal volume is bounded by a housing having at least one wall;

an acoustic channel which connects to the port and is also connected to a sound outlet and wherein the acoustic channel is not part of the internal volume;

wherein the sound outlet allows acoustic energy to exit from the acoustic channel;

a first acoustic pressure being generated in the front volume as the balanced armature motor moves the diaphragm;

wherein the acoustic channel and the internal volume are divided by a common wall section, wherein the common wall section is defined by at least one of the walls of the housing which also provides a portion of at least one wall for the acoustic channel;

a first length defined by a length of an acoustic path within the acoustic channel along the common wall section;

wherein the diaphragm has a longitudinal axis having a second length;

wherein the receiver has a longitudinal axis having a third length; and wherein a sum of the first length and the second length is greater than the third length.

6. The receiver of claim 5, wherein a portion of the acoustic channel that includes the common wall section bends at an angle greater than approximately 45 degrees.

7. The receiver of claim 5, wherein the common wall section is substantially parallel to the displaceable diaphragm component.

8. A receiver comprising:

a balanced armature motor which is mechanically interconnected to a displaceable diaphragm component;

a front volume, wherein the front volume changes as the displaceable diaphragm component moves and wherein the front volume is connected to a port; a rear volume, wherein the rear volume changes oppositely to the front volume as the displaceable diaphragm moves;

an internal volume, which is a combination of the front volume and the rear volume and wherein the internal volume is bounded by a housing having at least one wall;

an acoustic channel which connects to the port and is also connected to a sound outlet and wherein the acoustic channel is not part of the internal volume;

wherein the sound outlet allows acoustic energy to exit from the acoustic channel; a first acoustic pressure being generated in the front volume as the balanced armature motor moves the diaphragm; wherein the acoustic channel and the internal volume are divided by a common wall section, wherein the common wall section is defined by at least one of the walls of the housing which also provides a portion of at least one wall for the acoustic channel;

wherein a portion of the acoustic channel is bounded by the common wall section and by a second wall section opposite the common wall section;

wherein the common wall section is constructed from a first material;

wherein the second wall section is constructed from a second material;

wherein one or more of the first material and the second material are non-metallic.

9. The receiver of claim 8, wherein a portion of the acoustic channel that includes the common wall section bends at an angle greater than approximately 45 degrees.

10. The receiver of claim 8, wherein the common wall section is substantially parallel to the displaceable diaphragm component.

11. The receiver of claim 8, wherein the first material is more rigid than the second material.

12. The receiver of claim 8, wherein the acoustic channel surrounds an acoustic path, and wherein the acoustic path is filled or partially filled with partially or fully reticulated rigid foam.

13. The receiver of claim 8, wherein the first material and the second material are both non-metallic.

14. The receiver of claim 8, wherein the common wall section is acoustically sealed by at least one of frictional and elastomeric forces.

15. A receiver comprising:

a balanced armature motor which is mechanically interconnected to a displaceable diaphragm component;

a front volume, wherein the front volume changes as the displaceable diaphragm component moves and wherein the front volume is connected to a port;

a rear volume, wherein the rear volume changes oppositely to the front volume as the displaceable diaphragm moves;

an internal volume, which is a combination of the front volume and the rear volume and wherein the internal volume is bounded by a housing having at least one wall;

an acoustic channel which connects to the port and is also connected to a sound outlet and wherein the acoustic channel is not part of the internal volume;

wherein the sound outlet allows acoustic energy to exit from the acoustic channel;

a first acoustic pressure being generated in the front volume as the balanced armature motor moves the diaphragm;

wherein the acoustic channel and the internal volume are divided by a common wall section, wherein the common wall section is defined by at least one of the walls of the housing which also provides a portion of at least one wall for the acoustic channel;

wherein a portion of the acoustic channel is bounded by the common wall section and by a second wall section opposite the common wall section wherein the second wall section is smaller than the common wall section.

16. The receiver of claim 15, wherein a portion of the acoustic channel that includes the common wall section bends at an angle greater than approximately 45 degrees.

17. The receiver of claim 15, wherein the common wall section is substantially parallel to the displaceable diaphragm component.

18. The receiver of claim 15, wherein the acoustic channel surrounds an acoustic path, and wherein the acoustic path is filled or partially filled with partially or fully reticulated rigid foam.

* * * * *